United States Patent [19]

Felter et al.

[11] 3,952,638

[45] Apr. 27, 1976

[54] FANS FOR USE WITH TURBINE VENTILATORS, AND METHODS AND APPARATUS FOR SUPPORTING THE SAME

[76] Inventors: John V. Felter; John A. Bond; Kenneth M. Rudine, all of P.O. Box 7464, Houston, Tex. 77008

[22] Filed: Mar. 10, 1975

[21] Appl. No.: 556,694

[52] U.S. Cl. ..... 98/43 R; 98/75; 248/16

[51] Int. Cl.[2] ..... F24F 7/02

[58] Field of Search ..... 98/43 R, 72, 75, 114; 248/16, 57

[56] References Cited

UNITED STATES PATENTS

| | | | |
|---|---|---|---|
| 1,276,378 | 8/1918 | Kruse | 248/57 |
| 1,622,087 | 3/1927 | Calderwood | 248/57 X |
| 1,965,171 | 7/1934 | Boyer | 98/72 |
| 2,661,483 | 12/1953 | Tortorice | 248/57 X |
| 3,278,114 | 10/1966 | Gibbs | 98/43 |
| 3,903,443 | 9/1975 | Carlson | 248/16 X |

*Primary Examiner*—William E. Wayner
*Assistant Examiner*—William E. Tapolcai, Jr.
*Attorney, Agent, or Firm*—Carl B. Fox, Jr.

[57] ABSTRACT

Fans for use with turbine ventilators and apparatus and methods for supporting the same, wherein the fan is supported spaced from the entrance to the turbine ventilator whereby aspiration increases the air flow through the ventilator.

20 Claims, 18 Drawing Figures

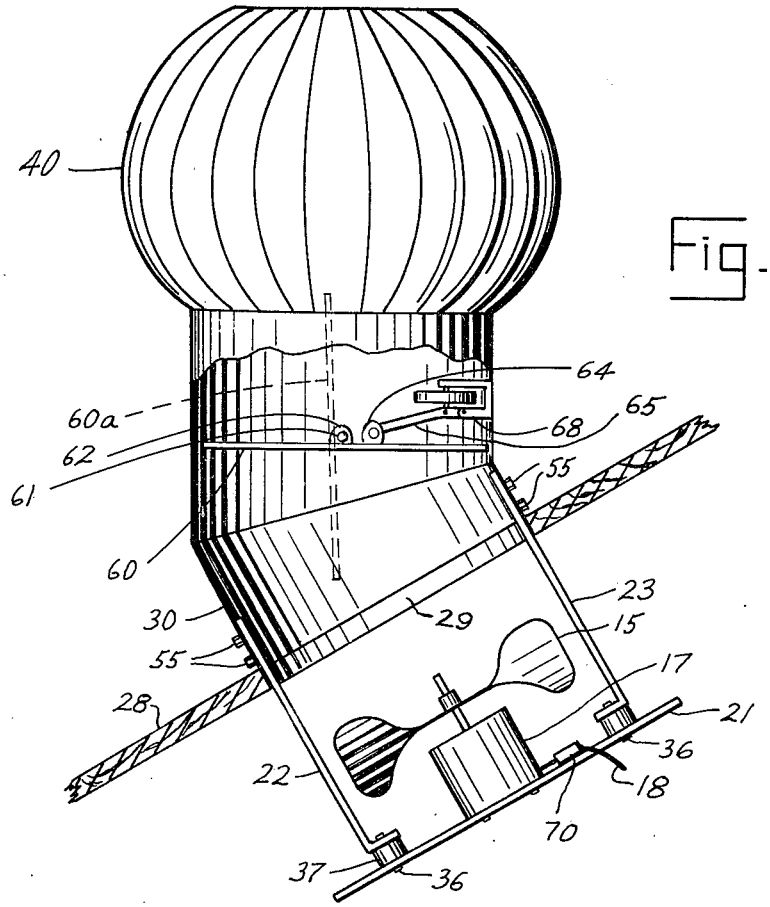
Fig. 7
Fig. 8
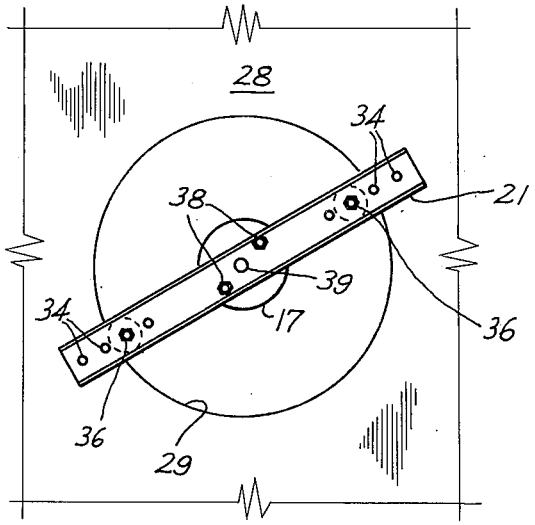

Fig. 9
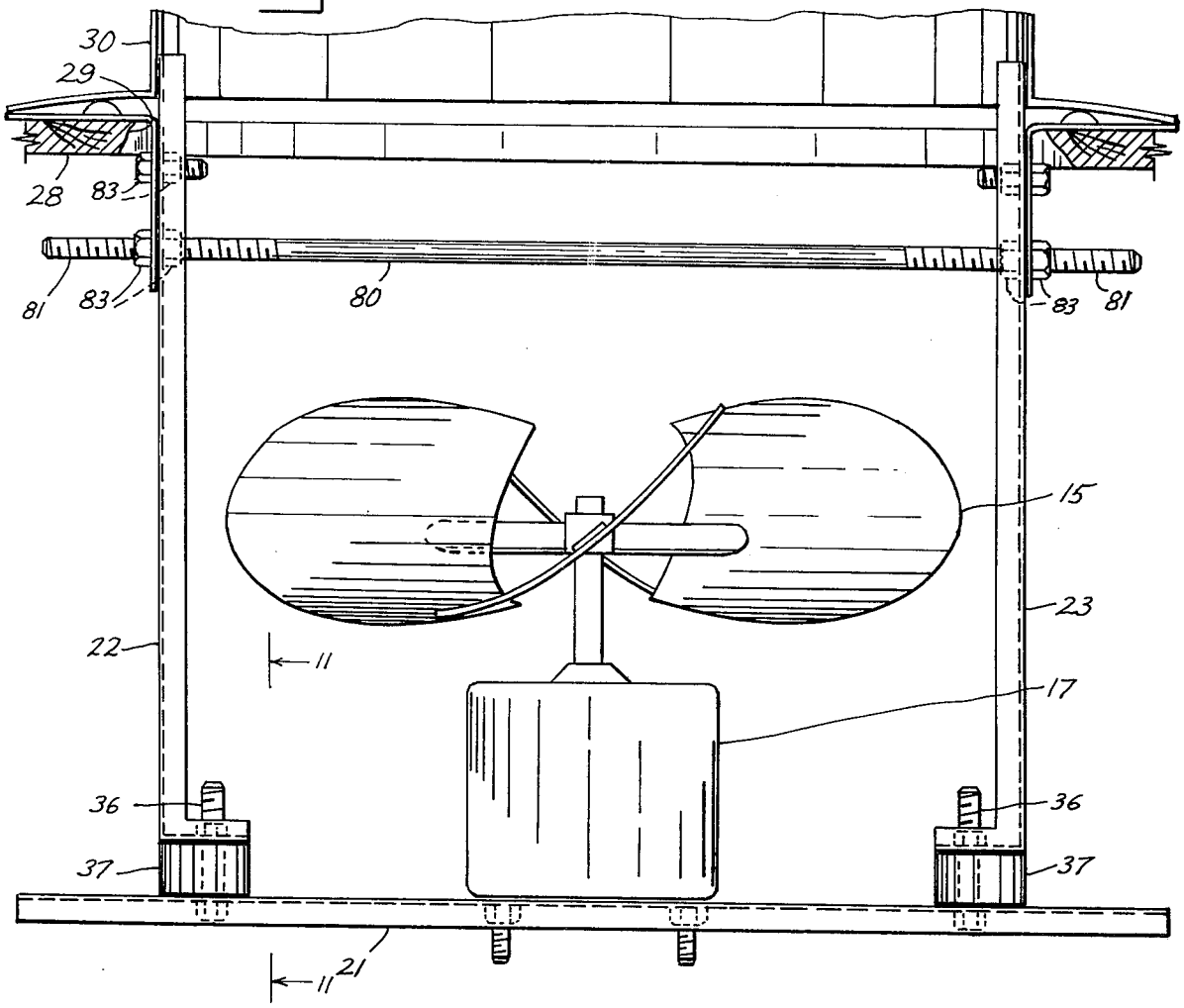
Fig. 10
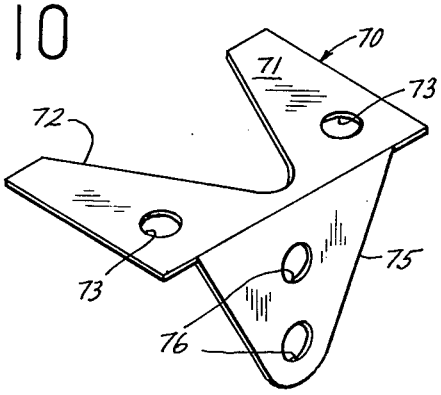
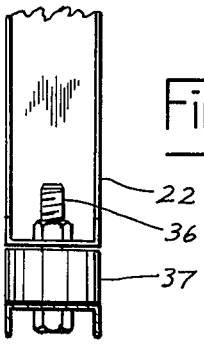
Fig. 11

FANS FOR USE WITH TURBINE VENTILATORS, AND METHODS AND APPARATUS FOR SUPPORTING THE SAME

SUMMARY AND BACKGROUND OF THE INVENTION

Turbine ventilators are in widespread use for ventilation of homes, offices, and commercial and industrial structures. While turbine ventilators afford reasonably good ventilation, the use of fans in conjunction with turbine ventilators will increase the air flow through the ventilators, thus increasing effective ventilation. Efforts in the past to combine fans or blowers with turbine ventilators have met with only limited success. Because of noise and vibration which results from the combination of fans into turbine ventilator structures, such combinations are not often used. Usually the speed of rotation of turbine ventilators having fans is increased to the point where the turbine ventilators rapidly wear out, with resultant increase of noise and vibration. The amount of air drawn through a turbine ventilator by a fan disposed therein is less than might be expected, so therefore the efficiency of turbine ventilators combining fans in their structures is low. This invention attempts to solve the problem of combining fans or blowers with turbine ventilators to provide an efficient apparatus which is essentially noise free and vibration free, and which is efficient in operation.

According to the invention, fans or blowers are provided together with supports therefor, for use with turbine ventilators. The fan is located spaced from the entrance to the turbine ventilator instead of within the roof jack or base of the ventilator itself. Investigation has revealed that this location of the fan or blower provides for increased air flow through turbine ventilators without the accompanying distractions of noise or vibration. Efficient directed air flow through the ventilators is provided at low operating cost using this type of assembly. The invention provides for the installation of fans in conjunction with new or existing turbine ventilators, which may if desired be accomplished on a do-it-yourself basis, in simple yet efficient manner.

The apparatus provided by the invention permits a variety of forms of installation, so that the combination of a fan with a turbine ventilator may be readily accomplished regardless of the manner of installation of the turbine ventilator. The fan support apparatus includes three elongate elements, two of which are identical, which may be assembled in a variety of ways. The elongate elements may be provided in straight, unbent form, or two of the elements may be provided in bent form to comply with a certain type of installation, as will become more clear as the description of the invention proceeds. The supports may be bent as necessary to provide the desired type of assembly. The assembly may be supported from the rafters of a building, from a roof jack supporting a rotary ventilator, from a rotary ventilator itself, or from a roof, the latter assembly requiring the use of special brackets provided for that purpose.

A principal object of the invention is to provide methods and apparatus for combining fans or blowers with turbine ventilators. Another object of the invention is to provide such apparatus and methods which are adaptable to a variety of turbine ventilator installations. A still further object of the invention is to provide such apparatus and methods which are dependable, efficient, and economical.

Other objects and advantages of the invention will appear from the following detailed description of preferred embodiments of the invention, reference being made to the accompanying drawings.

BRIEF DESCRIPTIONS OF THE DRAWINGS

FIG. 7 is a side elevation showing a modified installation of a fan in conjunction with a turbine ventilator.

FIG. 8 is a bottom elevation of the apparatus shown in FIG. 7.

FIG. 9 is a side elevation of still another modification of the installation of the apparatus.

FIG. 10 is a perspective view showing a bracket used in conjunction with the installation of FIG. 9.

FIG. 11 is a vertical cross section showing a portion of the apparatus of FIG. 9, taken at line 11—11 of FIG. 9.

DESCRIPTION OF THE PREFERRED EMBODIMENTS

Figure 1:
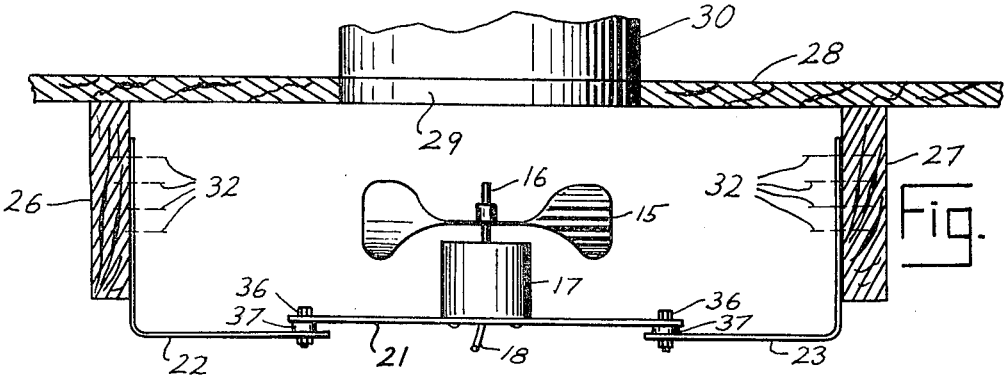
FIG. 1 is a side elevation showing a preferred apparatus according to the invention, shown installed in conjunction with a turbine ventilator.
Figure 2:
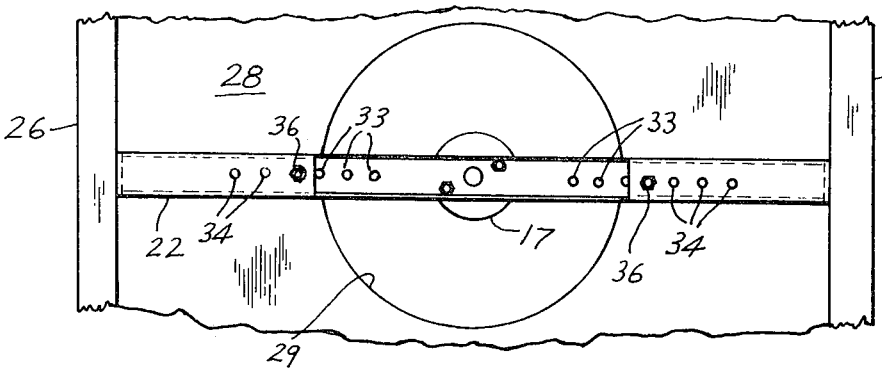
FIG. 2 is a bottom elevation of the apparatus shown in FIG. 1.

Referring now to the drawings in detail, and first to FIGS. 1–2, the fan or blower 15 is mounted for rotation on the shaft 16 of an electric motor 17, the latter having electrical conductor cable 18 extending thereto to provide electrical current for its operation. The fan and motor are supported by longitudinal elements 21, 22, 23, elements 22, 23 being identical. Elements 22, 23 may be provided in straight, unbent form, but are bent at 90° angles for use, the vertical portions being screwed or nailed to the sides of rafters 26, 27 supporting a roof 28. The roof 28 may be of any structure, and is shown in simplified form in the drawings.

Roof 28 has a circular opening 29 therethrough around which the lower tubular end of a roof jack 30 supporting a turbine ventilator 40 is installed. The exact structures of the roof jack and turbine ventilator are not shown in the drawing, and may be of any suitable form. The dashed lines 32 in FIGS. 1 and 3 indicate the positions of four screw holes which are provided through the upturned portions of strip elements 22, 23. Any or all of these holes may be used for fastening elements 22, 23 to rafters 26, 27. The longitudinal element 21 also has a plurality of screw holes 33 at each of its ends. The horizontal portions of elements 22, 23 have plural spaced holes 34 at their ends. The element 21 is connected at each of its ends to the ends of elements 22, 23, by bolts 36. Elastomeric washers 37 are disposed between the longitudinal elements to inhibit vibration transmission from the fan and motor to the building structure.

Figure 3:
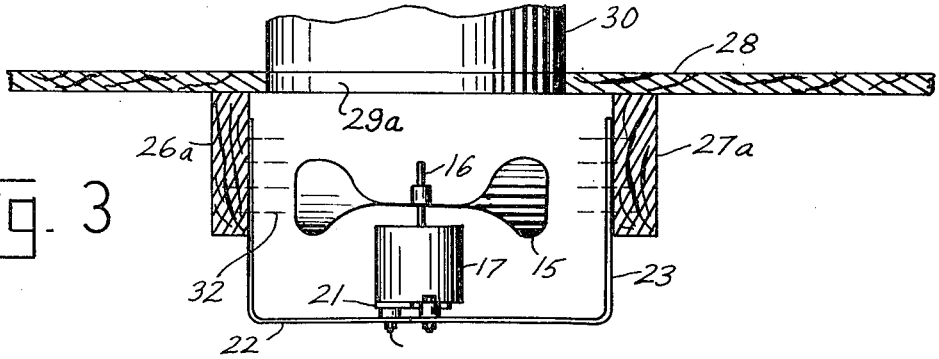
FIG. 3 is a side elevation of a modified installation of the apparatus shown in FIGS. 1 and 2.
Figure 4:
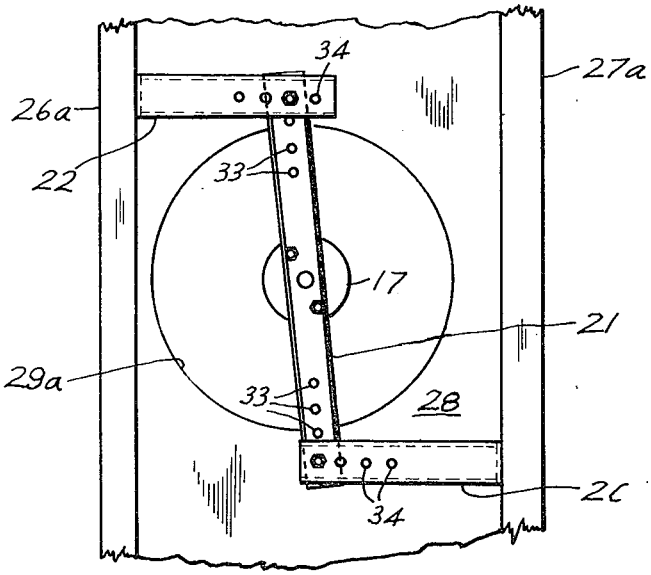
FIG. 4 is a bottom elevation showing the apparatus installed as in FIG. 3.

Referring now to FIGS. 3 and 4 of the drawings, the elements 21–23 are shown in a modified installation. In this installation, the rafters 26*a* and 27*a* are closer together than rafters 26, 27 of FIG. 1. The roof structure 28 has an opening 29 therethrough around which is connected the base of a roof jack 30 which supports a turbine ventilator at its upper end. In this case, the elements 22, 23 are screwed or nailed to the rafters 26*a*, 27*a* at longitudinally spaced points, and the element 21 is positioned angularly. Thus, it is seen that the elements 21–23 may be employed for support of a fan 15 and electric drive motor 17 between rafters or other building components of different spacings.

It should also be noticed, in FIGS. 3–4, that the roof opening 29*a* is off center with respect to the spacing between rafters 26*a*, 27*a*, i.e. the roof opening 29 is closer to rafter 26*a* than it is to rafter 27*a*. One end of longitudinal element 21 is connected to the hole 34 of element 22 which is second from the end, while the other end of element 21 is connected to the end hole of element 23 so that the fan is concentric with opening 29, off center between the rafters. By using different bolt holes 33, 34 it is possible to properly position the fan regardless of the location of the opening 29 between the rafters.

Referring now to FIGS. 12–15, the elements 21–23 may be provided as straight strips without bends, to be bent by the user as necessary to accommodate the blower or fan to the rotary ventilator beneath which it is to be installed. For example, the elongate strips 22, 23 are bent near their centers to accommodate the installations of FIGS. 1–4. The strips are bent at other locations to accommodate to the installations of FIGS. 7–8 and 9–11. The strips are preferably in the form of channels as shown, but flat or angle strips may be used instead.

Figure 5:
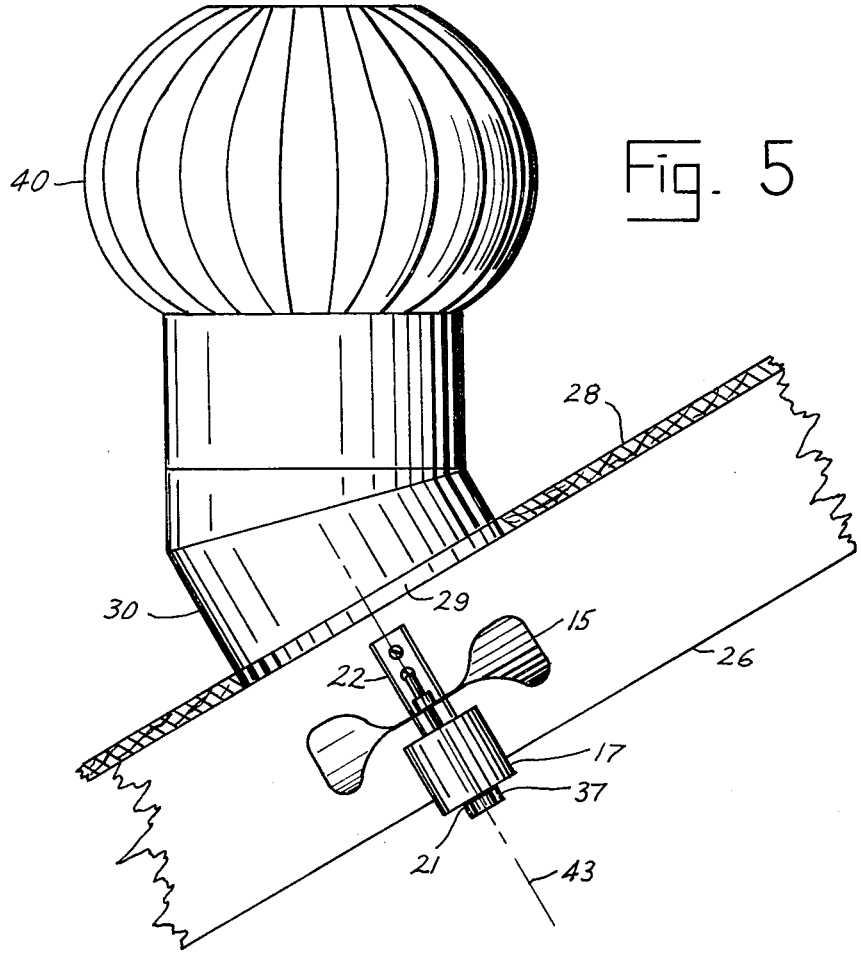
FIGS. 5 and 6 are vertical cross sections indicating two methods of installation of a fan in conjunction with a turbine ventilator, according to the precepts of the invention.
Figure 6:
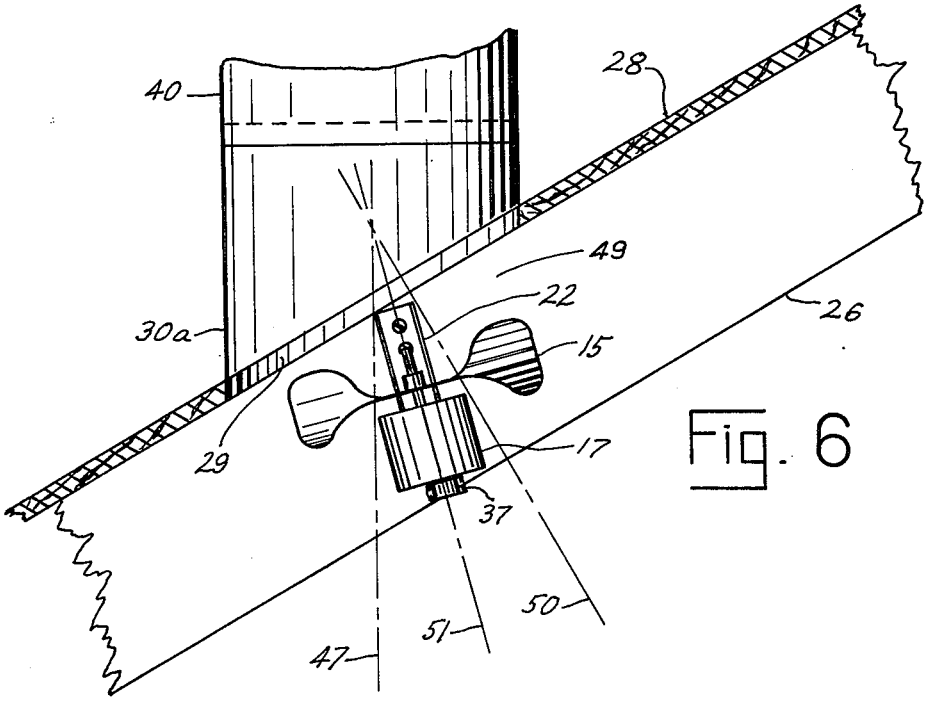
Figure 12:
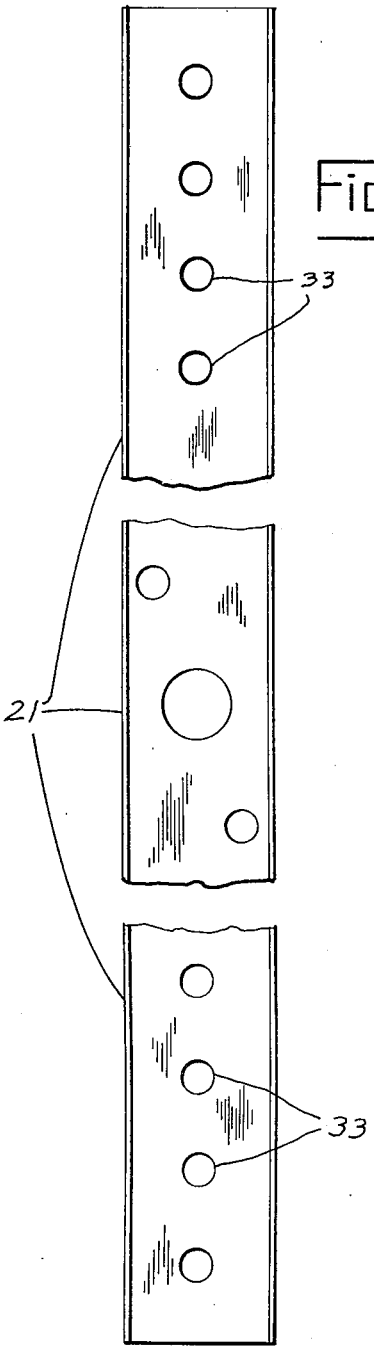
FIGS. 12–13 are side and end elevations, respectively, of one of the fan support elements, of preferred form.
Figure 14:
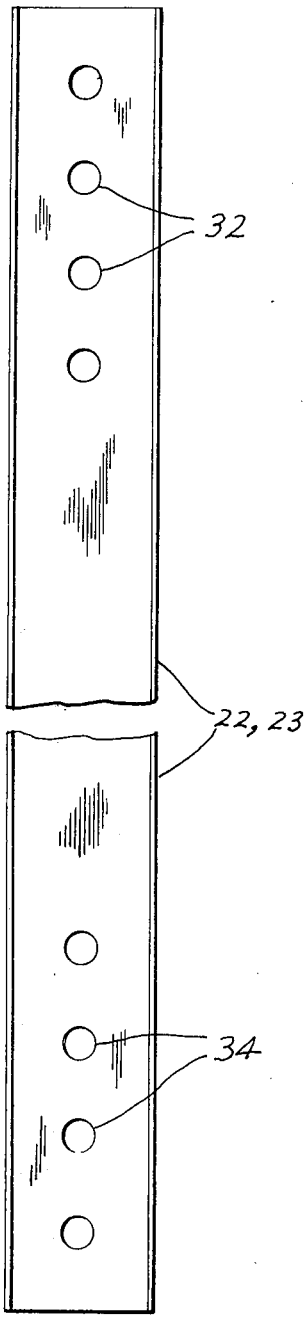
FIGS. 14–15 are side and end elevations, respectively, of another of the fan support elements, of preferred form.
Figure 13:
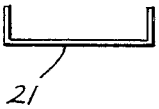
Figure 15:
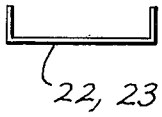

Referring now to FIGS. 5 and 6, the rotary turbine ventilator 40, FIG. 5, is mounted atop a roof jack 30 affixed (by means not shown) around opening 29 through the roof 28. The fan 15 and the motor 17 are supported by elongate elements 21–23 in the manner shown in FIG. 1. In this case, with the base of roof jack 30 perpendicular to roof 28, the fan is installed with its axis coincident with the axis 43 of the cylindrical bottom part of roof jack 30. The fan is spaced from the bottom of roof jack 30 and from the roof 28 by about the axial depth of the blades of fan 15.

Referring now to FIG. 6, a turbine ventilator 40 is shown installed at the upper end of a roof jack 30*a* which is axially vertical and angular to roof 28, and in line with the turbine throughout its length. It has been found that if the fan 15 is installed with its axis coincident with the axis 47 of roof jack 30*a*, then the fan 15 does not cause sufficient air flow through the rotary ventilator because of slippage or by passing which occurs at space 29 above the fan at the high side of the roof jack base. It has further been determined that if the fan is disposed axially of a line 50 perpendicular to the roof but angular with respect to the roof jack and turbine, then decreased air flow and excessive noise result because of air impelled against the left hand side of the roof jack and turbine. If the fan is disposed axially of line 50, then the turbine may even run out of balance to the extent that it will be damaged over a period of time. It has been found that the optimum position for the fan 15 is a position axially of a line 51 which is approximately midway between axis 47 and line 50. In this way, air friction against the left side of the roof jack is reduced while at the same time the air slippage or by passing at gap 29 is reduced to the point where efficient fan operation results.

Referring now to FIGS. 7–8, a rotary turbine ventilation 40 is shown mounted on an angular roof jack 30 having its base connected to roof 28 around hole 29 in the manner heretofore described. Elongate elements 22, 23 are bolted to the base of roof jack 30 by plural bolts 55 at opposite sides of the base. Elastomeric washers or pads 37 are disposed between the lower inwardly bent ends of the elements 22, 23 and the elongate element 21. Bolts 36 are received through the washers and through holes 33, 34 of elements 21, 22–23. Fan 15 and motor 17 are screwed to element 21 by screws passed through holes 38 of element 21. Another hole 39 is provided through element 21 at the location of the motor shaft. The fan 15 is disposed as indicated in FIG. 5, with the fan spaced about the distance of the blade axial thickness from the roof 28 and the lower edge of base 30. Since the base 30 is perpendicular to the roof 28, the axis of fan 15 is perpendicular to roof 28.

Still referring to FIGS. 7–8, ventilator 40 is provided with a vane 60 which may be opened or closed with respect to the lower air flow passage through the ventilator. The vane is mounted on a transverse rod 61 having its ends journaled to opposite sides of the ventilator base. U-shaped brackets 62 are connected to the vane and pass over rod 61. A bracket 64 depending from the vane is pivotally connected to a bar 65 forming the actuating lever of a thermostatic actuator 68. Motor 17 is provided with a thermostatic switch 70 in its electrical conductor connection 18.

These controls may be provided in any of the fan-ventilator assemblies herein described. The provision of actuator 68 and thermostatic switch 70 enable highly efficient operation of the rotary ventilator. The actuator 68 opens vane 60 to position 60*a* when the temperature at the actuator increases to a selected temperature of about 70°F to about 80°F. Therefore, the vane 60 remains closed when the temperature is cool, and is opened when the temperature increases and ventilation is required to maintain comfort.

The turbine ventilator operates in the normal manner without operation of fan 15 so long as the attic temperature does not exceed a cetain temperature. When the attic temperature reaches, say, 115°F, thermostatic switch 70 closes to turn on motor 17 to operate fan 15. The fan continues to operate until the attic temperature is reduced to, say 105°F. The fan 15, therefore, does not operate until the attic has become somewhat hot. This is contrary to normal operation of attic fans, and the like, which will usually be operated for long periods of time during hot seasons. The fan operates only to cool the attic down from 115°F to 105°F, then shuts off, permitting the turbine 40 to operate normally without a fan, but when the attic temperature again reaches 115°F then the fan comes on again to again cool the attic temperature.

This control assembly for turbine ventilators is a very economic means of achieving adequate ventilation during summer months even in hot climates. During cool temperature periods, the vane 60 remains closed so that heat from the attic is not dissipated through the ventilator to the atmosphere. During moderately hot seasons, the vane 60 is opened and the turbine ventilator operates in its usual manner to give adequate ventilation consistent with the temperature condition. During hotter weather, when the attic heats to 115°F, the fan 15 is operated to increase the ventilation through the rotary ventilator consistent with the prevailing hotter temperatures. Thus, electrical energy for operation of the fan is reserved for periods when it is needed, and during cooler temperature periods the rotary ventilator performs its usual function without use of electrical energy. Therefore, the system is adapted to give ventilation capacity consistent with the temperature, without wasted energy.

Figure 16:
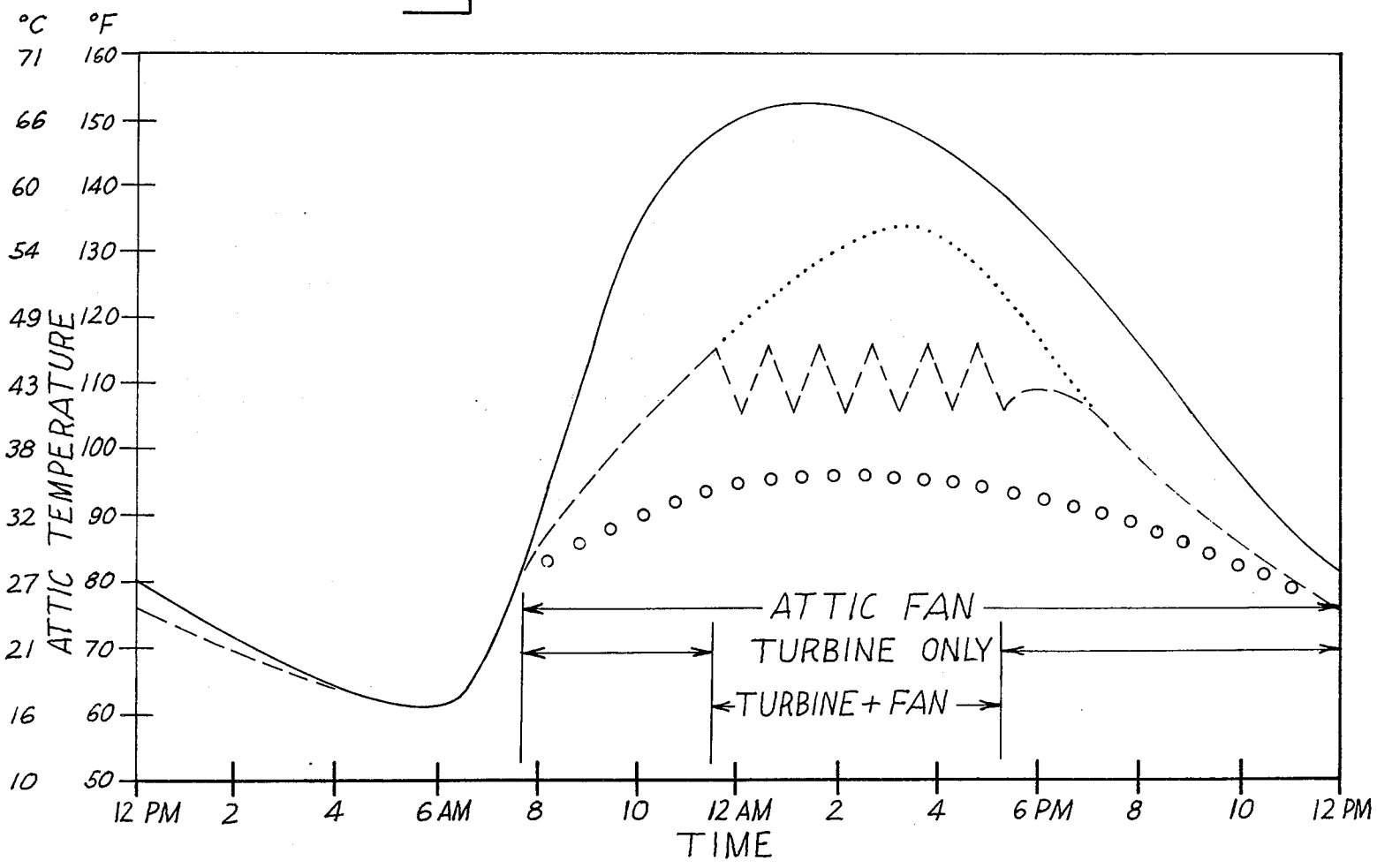
FIG. 16 is a graph showing representative attic temperatures throughout the day with different forms of ventilation apparatus.

The operation of the described control method is illustrated in FIG. 16 of the drawings. The solid line curve shows exemplary attic temperatures during a one day period. The curve which includes the dotted line portion exemplifies how the attic temperature is reduced by a normal turbine ventilator installation. The curve which includes the zig zag dashed line portion exemplifies the reduction in attic temperatures caused by a turbine ventilator controlled as shown in FIGS. 7–8. The curve which includes the circle line portion exemplifies the reduction in attic temperatures caused by a turbine ventilator having a fan mounted according to the invention with the fan operating uninterruptedly through the daylight hours. Although better cooling is received with constant fan operation, much better energy efficiencies result with the controlled intermittent fan operation which gives satisfactory cooling. FIG. 16 also indicates cooling received from a typical attic fan installation, which also follows the curve which includes the circle line portion.

Referring now to FIGS. 9–11 of the drawings, there is shown still another alternative method of assembly of a fan with a rotary ventilator using the elements 21–23. In this case, the elements 21–23, which are shown in their straight, unbent, forms in FIGS. 12–15, are bent so that the terminal holes 32 of elements 22–23 may receive bolts 36. Element 21 is bolted thereacross with elastomeric washers 37 in place between the elements as before. However, in this alternative installation, a bracket 70 is employed which is shown in FIGS. 9 and 10. Bracket 70 has a horizontal portion 71 having a large V-notch 72 which eases insertion under roofing materials where necessary. A pair of holes 73 are provided for connection of the bracket to a roof surface. A downwardly extending V-shaped portion 75 has a pair of bolt holes 76 for connection of the bracket to the elements 22, 23 and to a rod 80. The roof jack 30 is connected to the roof over the brackets 70, and the turbine ventilator is connected to the upper end of the roof jack. The motor 17 and fan 15 are assembled to element 21 as heretofore described. In this modification of installation, which is stronger than the other methods of assembly, the rod 80 having threads 81 at each of its ends is used for assembly of the elements 22, 23 to the two elements 70. The rod extends through the holes 32 of elements 22, 23 and through the lower hole 76 of the fitting 70 and is secured by four nuts 83, one disposed inwardly and one disposed outwardly at each end of rod 80. This structure stabilizes the elements 22, 23 and reinforces the assembly. The rod 80 may be used with the other assemblies shown in the other drawings.

Figure 17:
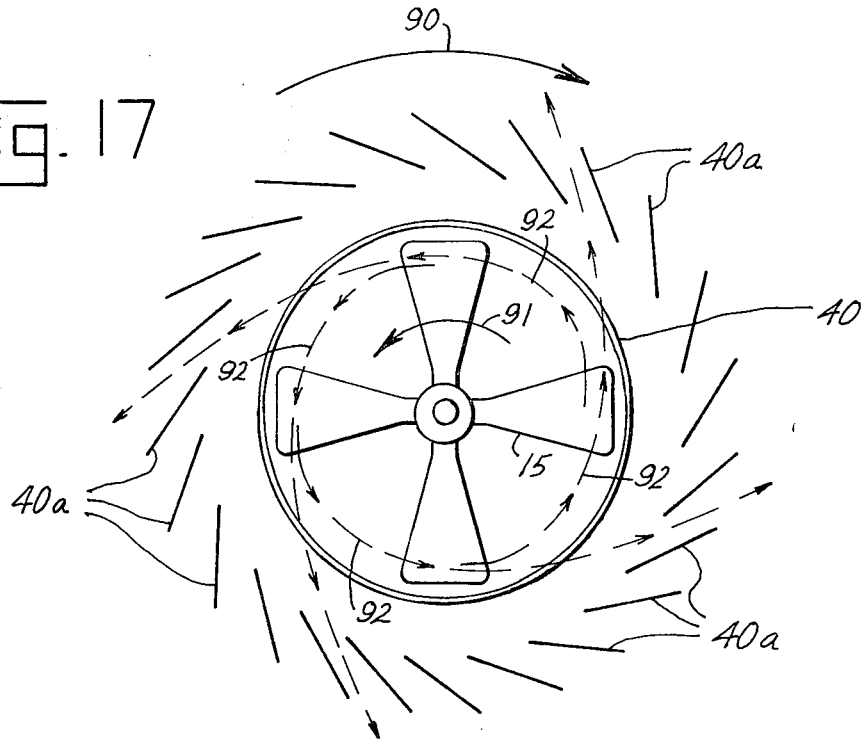
FIGS. 17–18 are schematic drawings indicating the effect of fan rotation on ventilator rotation.
Figure 18:
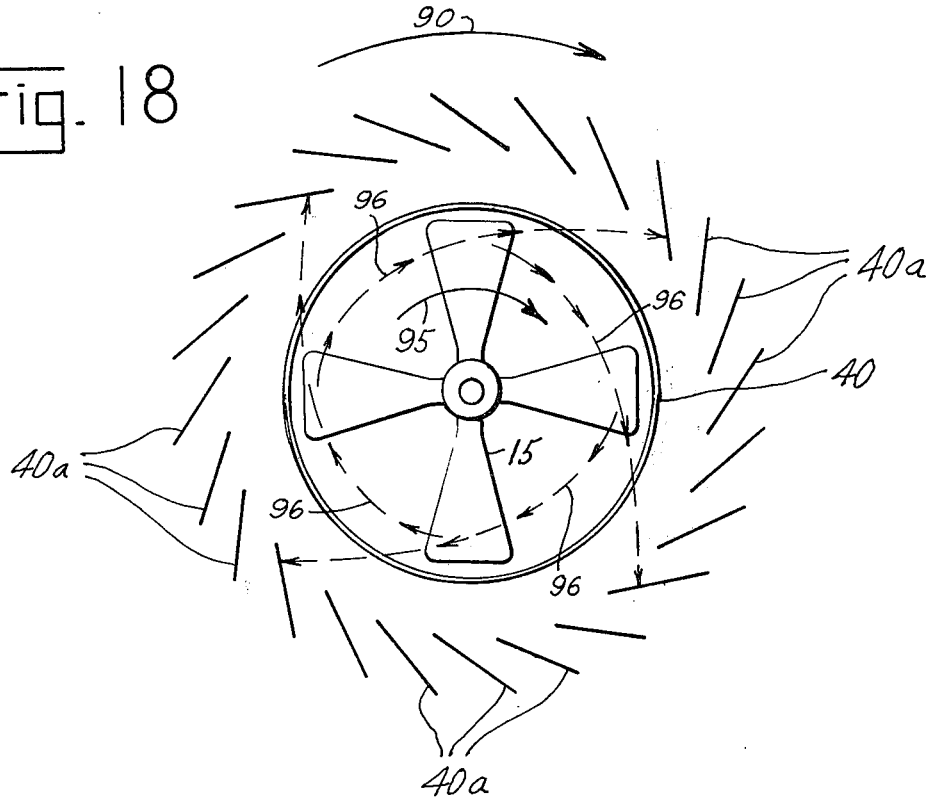

Referring to FIGS. 17–18, the effect of the direction of rotation of fan 15 on the ventilator rotation is shown schematically. In FIG. 17, ventilator 40 has vanes **40*a* which rotate clockwise as indicated by arrow 90, and fan 15 rotates counterclockwise as indicated by arrow 91. The air from fan 15 is impelled upward through the ventilator in a counterclockwise spiral as indicated by dash lines 92. As can readily be understood, the air travel is such as to pass smoothly without undue turbulence between vanes 40*a*, and the air exit direction is not such as to materially increase the rotational speed of the vanes 40*a* of ventilator 40.**

In FIG. 18, the vanes **40*a* rotate clockwise as indicated by arrow 90, and the fan 15 also rotates clockwise as indicated by arrow 95. The air is moved upward through the ventilator in a clockwise spiral, as indicated by dash lines 96. As will be clear, the air flow is directed against the sides of vanes 40** in directions causing an increase in the rotation speed of the ventilator. This causes a decrease in the volume of air flow because of the resulting air turbulence. The turbulence and increased ventilator speed also increases the noise.

Therefore, while the fan may rotate in either direction relative the direction of ventilator rotation, it is preferred that the fan and ventilator rotate in opposite directions in order that the air flow will be maximum and the noise level low.

The increased speed of rotation of the ventilator when the fan rotates in the same direction as the ventilator also causes increased friction at the ventilator bearings and shortens the useful life of the ventilator.

It should be understood that any of the methods of assembly using the elements 21, 22–23 may be used on a roof of any pitch, with the fan positioned in accordance with the teachings described in FIGS. 5–6. It will be realized, for example, in FIG. 9, that the bolts 36 may be assembled through any of the holes 33 of element 21, and the connection of elements 22, 23 to the element 70 may utilize any of the holes 32 and 34 of the elements 22, 23.

While preferred embodiments of the method and apparatus have been described and shown in the drawings, many modifications thereof may be made by a person skilled in the art without departing from the spirit of the invention, and it is intended to protect by Letters Patent all forms of the invention falling within the scope of the following claims.

We claim:

1. Method for positioning and supporting a revolving fan for use in conjunction with a rotary turbine ventilator, comprising positioning the fan adjacent to but outside of the air inlet of the rotary turbine ventilator with the axis of the fan directed toward a central part of the air inlet in the direction of air flow from the fan, and providing a support for the fan in the described position, whereby the fan when operated to impel air into the ventilator inlet will cause aspiration of additional air into the inlet from around the air stream delivered by the fan into the inlet.

2. Method according to claim 1, the rotary ventilator including a tubular roof jack disposed vertically above an angular roof, wherein the fan is positioned with its axis approximately midway between the axis of the roof jack and a vertical line intersecting the axis of the roof jack within the lower end portion of the roof jack.

3. Method according to claim 1, the rotary ventilator including a tubular roof jack having an upper vertical portion connected to the lower end of the rotary ventilator and an angular lower portion connected perpendicularly to an angular roof, wherein the fan is positioned with its axis coincident with the axis of the angular lower portion of the roof jack.

4. Method according to claim 1, the rotary ventilator including a tubular roof jack having its lower end nonperpendicular to the axis of its lower end portion, wherein the fan is positioned with its axis approximately midway between the axis of the lower end portion of the roof jack and a line perpendicular to the lower end of the roof jack which intersects the axis of the lower end portion of the roof jack within the lower end portion of the roof jack.

5. Method according to claim 1, the rotary ventilator including a tubular roof jack having its lower end perpendicular to the axis of its lower end portion, wherein the fan is positioned with its axis coincident with the axis of the lower portion of the roof jack.

6. In combination with a rotary ventilator and a fan-motor assembly mounted beneath said ventilator, apparatus comprising a first elongate element adapted for connection at an intermediate point of its length to the motor of said fan-motor assembly, second and third elongate elements each bendable to L-shaped form intermediate of their lengths whereby one end of each of said second and third elongate elements may be connected to supports at opposite sides of said rotary ventilator and the other end of each of said second and third elongate elements may be connected against the opposite ends of said first elongate element, said other ends of said second and third elongate elements being disposable in line with or at any angle to said first elongate element whereby said one ends of said second and third elongate elements may be connected to supports at different distances apart, said second and third elongate elements being bendable at different points of their lengths to adjust the fan distance from the rotary ventilator.

7. The combination of claim 6, said first, second and third elongate elements having transverse channel cross sections.

8. The combination of claim 6, said first, second and third elongate elements each having multiposition connection means along each of their ends whereby the position of the fan-motor assembly may be adjusted.

9. The combination of claim 8, said connection means each comprising plural holes spaced longitudinally of the elements.

10. The combination of claim 6, including elastomeric washer means between said first elongate element and each of said second and third elongate elements at said connections therebetween.

11. In combination with a rotary ventilator and a fan-motor assembly mounted beneath said ventilator, apparatus comprising an elongate element adapted for connection at an intermediate point of its length to the motor of said fan-motor assembly, a pair of L-shaped elements each connectable at the other end against opposite ends of said elongate element, said other ends of said L-shaped elements being disposable in line with or at any angle to said elongate element whereby said one ends of said L-shaped elements may be connected to supports at different distances apart.

12. The combination of claim 11, said elongate element and said L-shaped elements each having transverse channel cross sections.

13. The combination of claim 11, said elongate element and said L-shaped elements each having multiposition connection means along each of their ends whereby the position of the fan-motor assembly may be adjusted.

14. The combination of claim 13, said connection means each comprising plural holes spaced longitudinally of the element.

15. The combination of claim 13, said one ends of said L-shaped elements being connected to angular brackets adapted for connection to a roof.

16. The combination of claim 13, including threaded stabilizer rod means connectable between said connection means at said one ends of said L-shaped elements.

17. The combination of claim 13, said connection means at said one ends of said L-shaped elements being connected to rafters of a roof.

18. The combination of claim 13, said connection means at said one ends of said L-shaped elements being connected to opposite sides of a roof jack supporting the rotary ventilator.

19. The combination of claim 11, including elastomeric washer means between said elongate element and each of said L-shaped elements at said connections therebetween.

20. The combination of claim 6, said motor driving said fan in a rotational direction opposite the direction of rotation of said rotary ventilator, whereby the air impelled through said rotary ventilator is moved spirally in a direction to exit smoothly between the vanes of said rotary ventilator without substantially increasing the rotational speed of said rotary ventilator.

* * * * *